US005363965A

United States Patent [19]

Nguyen

[11] Patent Number: 5,363,965

[45] Date of Patent: Nov. 15, 1994

[54] SELF-OPENING THERMOPLASTIC BAG SYSTEM

[76] Inventor: Tai H. Nguyen, 83 Monterrey Dr., Kenner, La. 70065

[21] Appl. No.: 124,278

[22] Filed: Sep. 20, 1993

[51] Int. Cl.[5] ..... B65D 33/14

[52] U.S. Cl. ..... 206/554; 383/9; 383/37

[58] Field of Search ..... 206/554; 383/8, 9, 37; 53/452, 390

[56] References Cited

U.S. PATENT DOCUMENTS

| | | | |
|---|---|---|---|
| 3,869,065 | 3/1975 | Wang | 221/40 |
| 4,562,925 | 1/1986 | Pistner | 206/554 |
| 4,676,378 | 6/1987 | Baxley et al. | 206/554 |
| 4,989,732 | 2/1991 | Smith | 206/554 |
| 5,014,852 | 5/1991 | Herrington et al. | 206/554 |
| 5,183,158 | 2/1993 | Boyd et al. | 206/554 |
| 5,188,235 | 2/1993 | Pierce et al. | 206/554 |
| 5,207,328 | 5/1993 | Bose et al. | 206/554 |
| 5,213,145 | 5/1993 | Huang et al. | 53/390 |
| 5,269,605 | 12/1993 | Nguyen | 206/554 |

*Primary Examiner*—Jimmy G. Foster
*Attorney, Agent, or Firm*—Joseph T. Regard, Ltd.

[57] ABSTRACT

A bag and system for dispensing self-opening thermoplastic bags or the like from a stack of bags. The present system is configured such that it may be utilized with a variety of off-the-shelf rack configurations, and to provide optimal characteristics for dispensing bags one at a time, while further providing a system wherein the bag to be dispensed may be retained in an open position, to allow for the loading thereof with contents for carrying, such as purchased goods or the like. The system is further configured such that the loaded bag, when dispensed, draws the next bag in the stack forward into an open loading position such that it is ready to be loaded with goods without further manipulation by the attendant. The preferred embodiment of the present invention teaches the utilization of a star, X, or cross configured punch applied to the handle area of the bags as a pack, to hold said handles together for handling of the bag pack, and for facilitating opening of the next bag in the stack on the rack, when a loaded bag is removed.

5 Claims, 7 Drawing Sheets

SELF-OPENING THERMOPLASTIC BAG SYSTEM

BACKGROUND OF THE INVENTION

Invention Field

The present invention relates to bag dispensing systems, and particularly to a bag and system for dispensing self-opening thermoplastic bags or the like from a stack of bags. The present system is configured such that it may be utilized with a variety of off-the-shelf rack configurations, and to provide optimal characteristics for dispensing bags one at a time, while further providing a system wherein the bag to be dispensed may be retained in an open position, to allow for the loading thereof with contents for carrying, such as purchased goods or the like. The system is further configured such that the loaded bag, when dispensed, draws the next bag in the stack forward into an open loading position such that it is ready to be loaded with goods without further manipulation by the attendant.

The preferred embodiment of the present invention teaches the utilization of a star, X, or cross configured punch applied to the handle area of the bags as a pack in such a manner as provide a punched region in the pack, to hold said handles together for handling of the bag pack, and for facilitating opening of the next bag in the stack on the rack, when a loaded bag is removed.

GENERAL BACKGROUND DISCUSSION

Although the prior art has contemplated literally hundreds of various designs for bags and bag dispensing systems, relatively few have proved easily implemented and few yet have proved consistent in performance.

A list of prior patents which may be of interest is presented below

| Patent No. | Inventor(s) | Issue Date |
|---|---|---|
| 5,123,145 | Huang et al | May 25, 1993 |
| 5,183,158 | Boyd et al | Feb 02, 1993 |
| 5,014,852 | Herrington et al | May 14, 1991 |
| 4,989,732 | Smith | Feb 05, 1991 |
| 4,676,378 | Baxley et al | Jun 30, 1987 |
| 4,562,925 | Pistner | Jan 07, 1986 |
| 3,869,065 | Wang | Mar 04, 1975 |

U.S. Pat. Nos. 4,989,732 and 5,183,158 to Mobil Oil Corporation teaches a self opening bag system wherein there is contemplated a thermoplastic bag pack having handles emanating from opposing sides of a bag mouth, wherein there is provided a pressure bonded area of the pack, such that the plastic film of the bags are in "face to face" engagement between the top and base of the handles, and beneath the medial area of the bag mouth.

The Mobil patents are distinguishable from the present invention, as they contemplate a non-permeating engagement of the film in the various layers of plastic forming the bag pack. Further, unlike the Mobil patents, the present invention does not require pressure-bonding below the mouth of the bags, as is specifically contemplated, and believed required, for the Mobil system to work.

Unlike Mobil, the present systems punch configuration for providing a permeated, releasible pressure bond provides sufficient releasable binding of the film layers to draw the next bag open for dispensing, with the removal of the full bag from the rack, without the necessity of the medial pressure bond below the bag mouth as in '732, as well as a separate pressure bond at the base of the bag and pack, as contemplated and claimed in '158.

SUMMARY DISCUSSION OF THE INVENTION

Unlike the prior art, the present invention provides a self opening bag and dispenser system which is consistent in performance, and comparatively strong and reliable, while being inexpensive to manufacture, requiring little in the way of custom manufacturing equipment.

The present invention is taught in the preferred embodiment of the present invention is to be utilized in conjunction with a pack of T-shirt thermoplastic bags or the like, which are dispensed from a rack having first and second elongated, somewhat horizontally displaced bag handle holding members, and a central tab piece emanating from the bag mouth.

As taught, the present invention teaches the application of two somewhat longitudinally aligned star, X, or cross configured punches along the handle area of the bag pack, near the edge of the handles juxtaposed the bag mouth.

It has been found that this configuration punch, which not only applies a pressure bond to the plastic film forming the bags and bag pack, but also to a degree permeates said walls, provides sufficient bonding between the walls to allow for the consistent dispensing of a bag from the pack with the removal from the rack of a previously dispensed bag. Other configured punches have failed to perform in such a manner.

It is therefore an object of the present invention to provide a self opening bag system which may be utilized with a variety of configurations of bag packs to be dispensed from a rack.

It is another object of the present invention to provide a self opening bag system which is relatively easily implemented, cost effective, and reliable.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
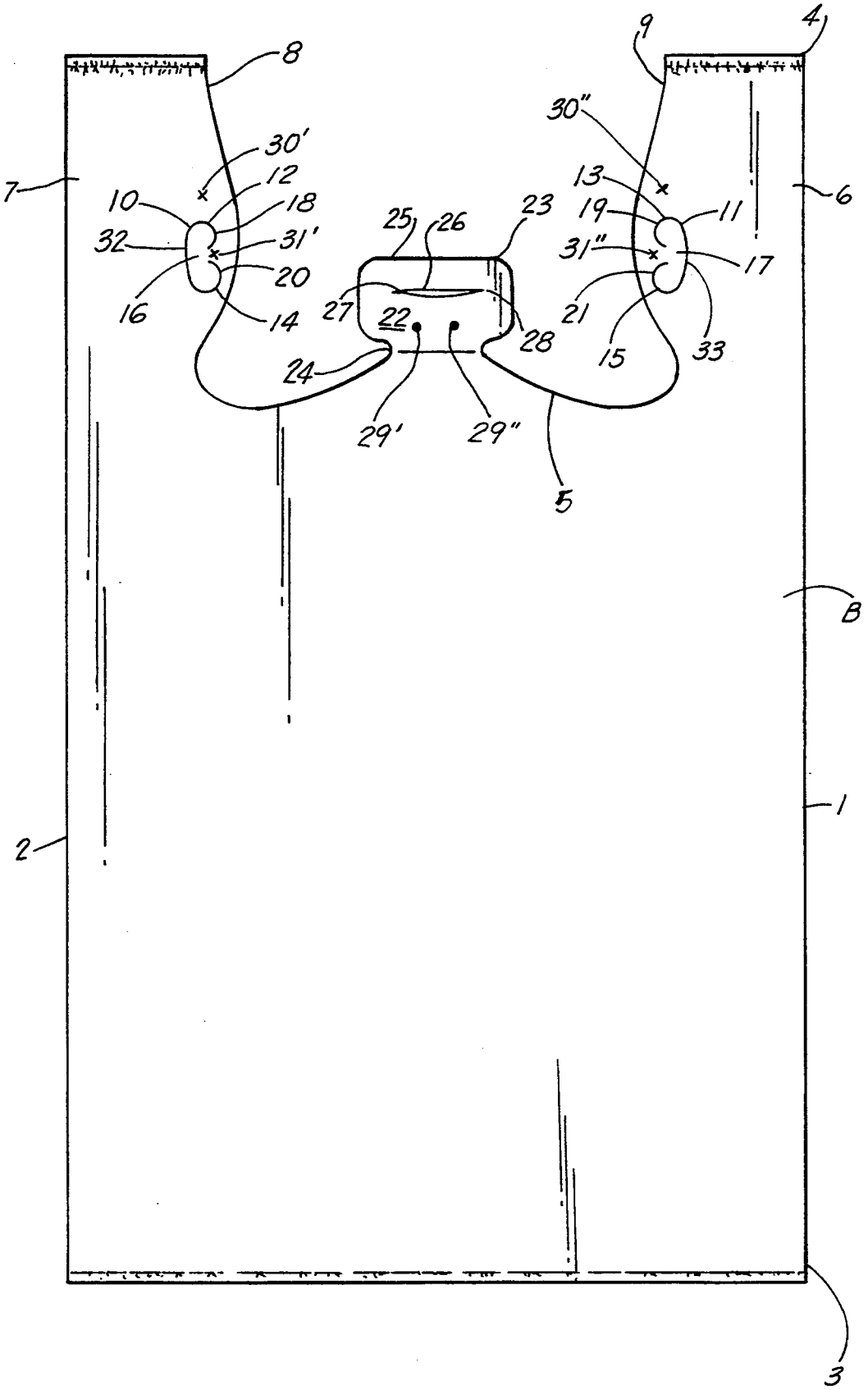
FIG. 1 is a frontal view of the bag of the preferred, exemplary embodiment of the present invention, illustrating the self-opening punch configuration and placement thereof.

As can be seen in FIG. 1, the bag B of the preferred, exemplary embodiment of the present invention, includes first 1 and second 2 sides, a bottom 3 and top 4 ends, and a mouth 5. Emanating from opposing ends of the mouth 5 are first 7 and second 6 handles, each handle having an inner side edge 8, 9, respectively. Further included in the handles 7, 6, are first and second handle support cuts 10, 11, respectively. Each handle support cut 10, 11, as shown, respectively includes an upper section 12, 13, a lower section 14, 15, and a medial section 32, 33 therebetween. The handle support cuts may be formed via cutting die or the like pressed upon and through the bag or bag pack.

As further shown in FIG. 1, the handle support cuts 10, 11 of the preferred, exemplary embodiment of the present invention respectively upper 18, 19 and lower 20, 21 inwardly directed curves forming the upper 12, 13 and lower 14, 15 sections, respectively, the curves directed generally toward the inner side edges 8, 9 of the handles, respectively, forming a medial cut area. In addition, each upper curve is directed toward its respective lower curve, and visa versa, forming an uncut, medial portion 16, 17 therebetween.

The handle support cuts further comprise a linear portion 32, 33 situated generally between the curved portions of the slit and the outer sides 2,1 of the bag, the linear portion 32, 33 in general parallel alignment with the longitudinal axis of the bag.

Emanating from the bag mouth 5 is tab 22, having a neck 24, and an upper, bulbous portion 23 having an end 25. Formed and situated in the bulbous portion 23 of tab 22 is the tab support cut 26 having first 27 and second 28 ends.

Figure 2:
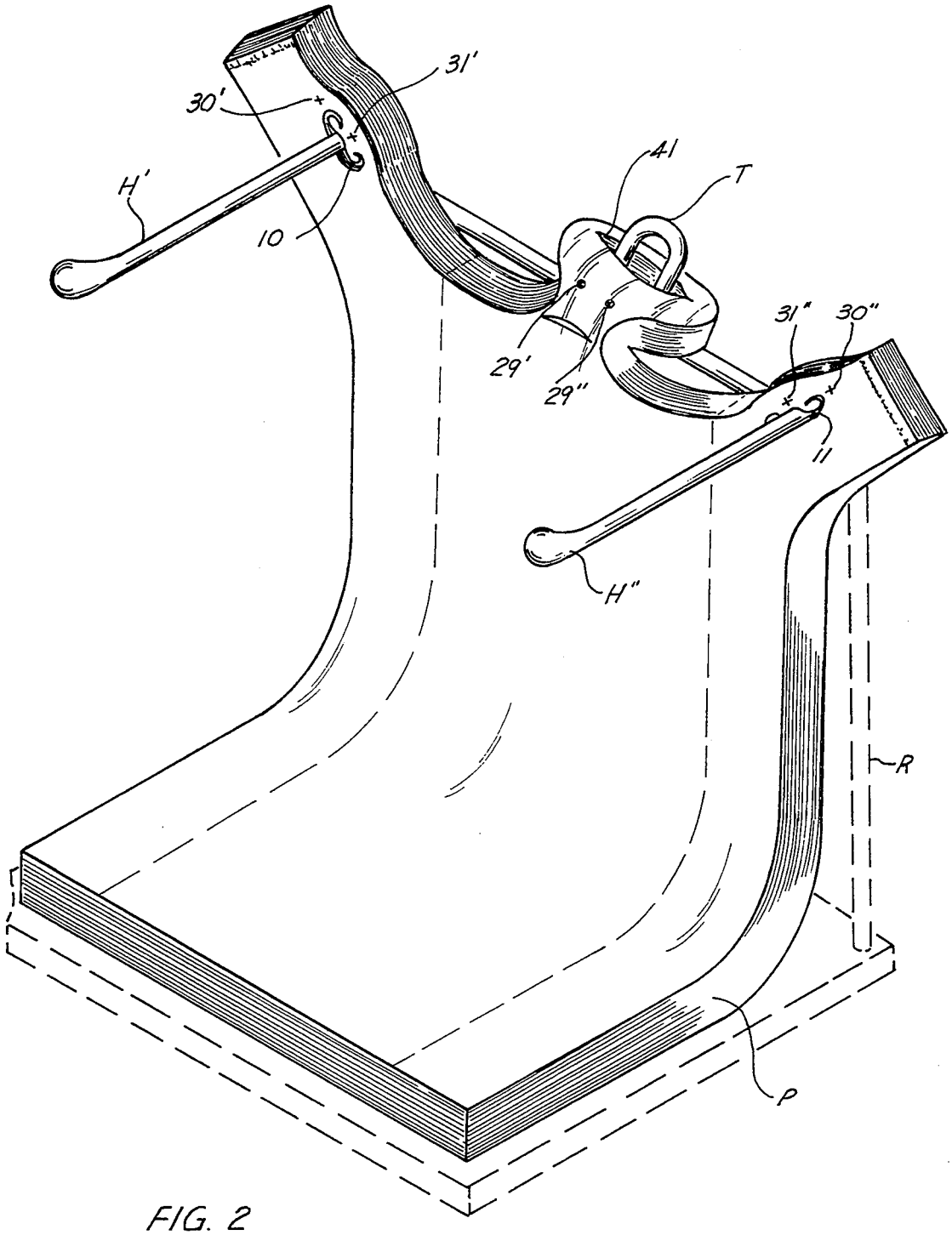
FIG. 2 is an isometric view of the bag pack of FIG. 1, as it is placed upon an exemplary rack, illustrating the communication of the support cuts with the various rack support members, and the relation of the self-opening punches thereto.

As shown in FIG. 2 of the drawings, the bag pack of the present invention may be dispensed upon a rack R having first and second, somewhat horizontally situated handle support members H', H'', and a tab support member T, configured to communicate with handle support cuts 10, 11 and tab support cut 26, respectively.

Figure 3:
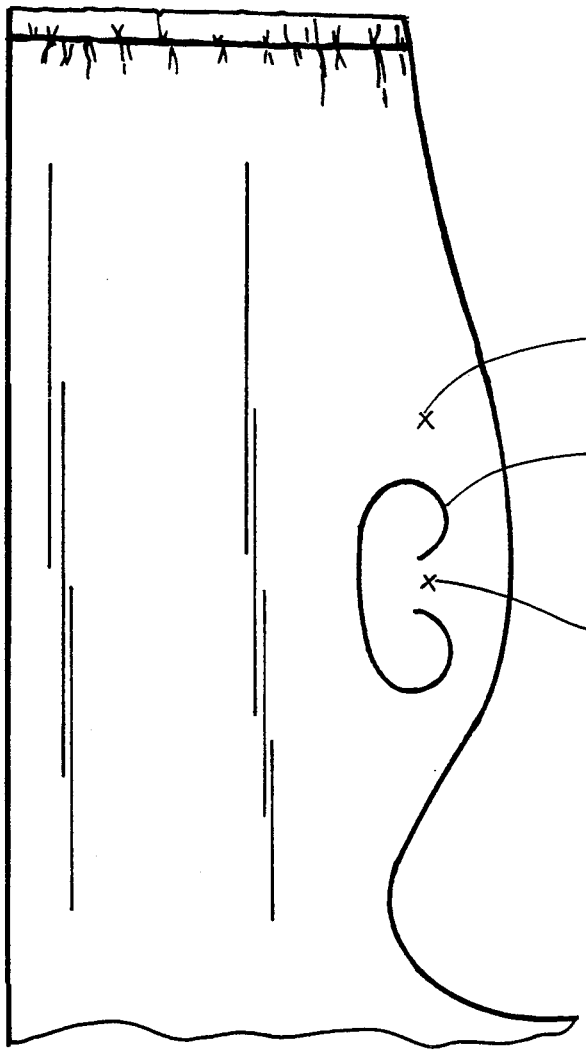
FIG. 3 is a frontal, close up view of the placement of the self-opening punch relative the handle cuts and inner wall of the handle.
Figure 8:
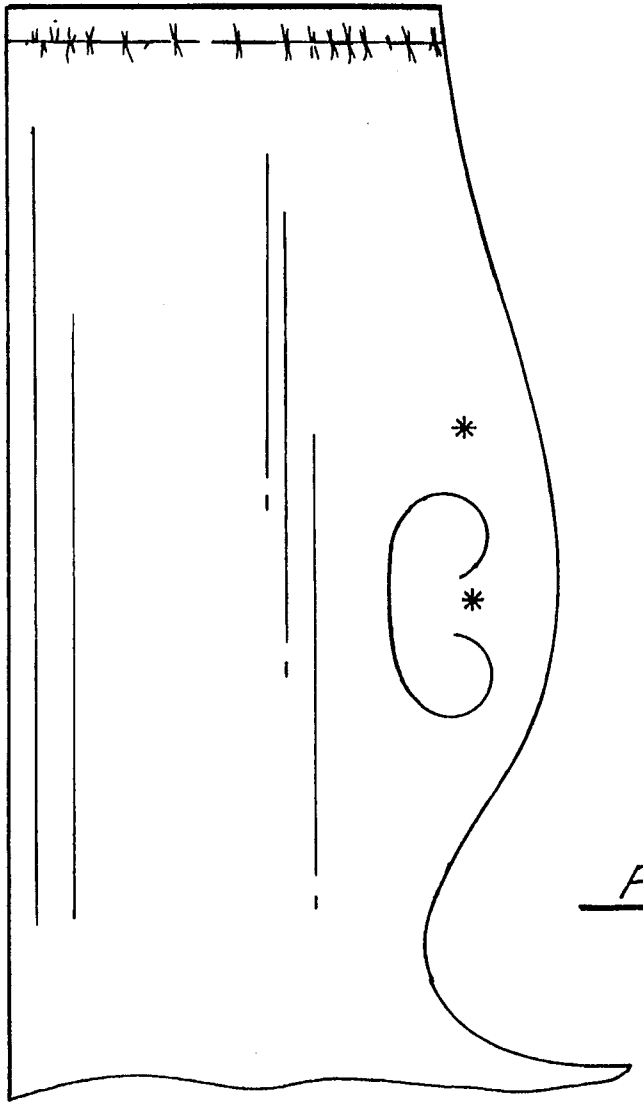
FIG. 8 is a close up, frontal view of the handle of the bag of the invention of FIG. 1, illustrating an alternative, star-configured punch.
Figure 7:
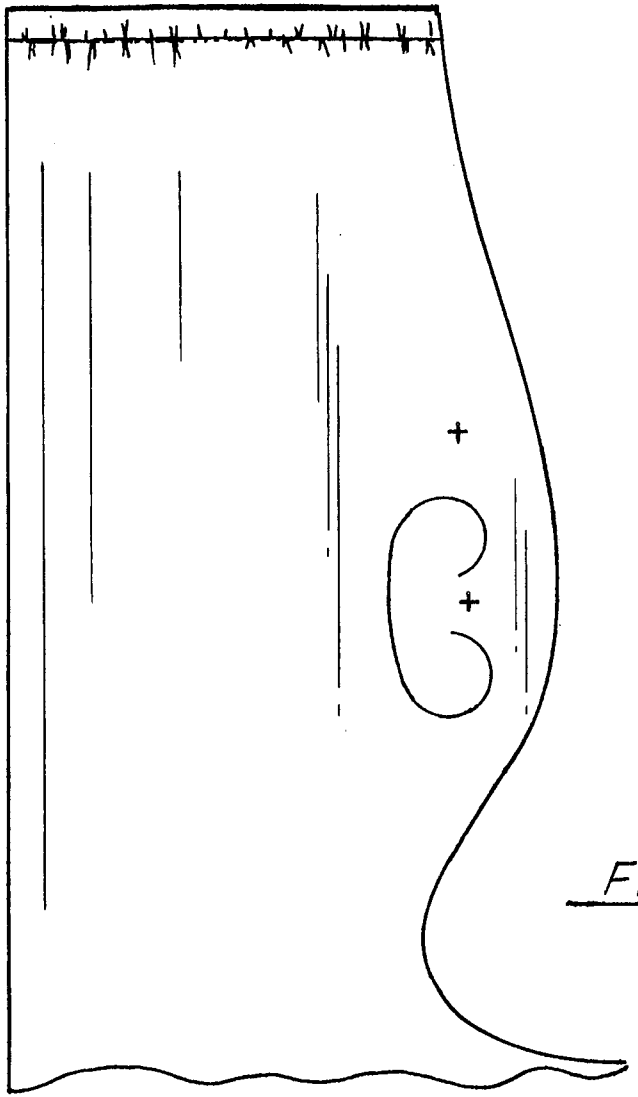
FIG. 7 is a close up, frontal view of the handle of the bag of the invention of FIG. 1, illustrating an alternative, cross-configured punch.

The individual bags of the present invention are held together in a bag pack P via the utilization of a heated or cold punch 29 formed near the tab 40, and punches 30', 30'', 31', 31'' formed in the handles, in the preferred embodiment, punches 31', 31'' formed in the medial cut area, generally between the inwardly directed curves forming the handle support cuts of the handles and punches 30', 30'' juxtaposed the upper end of the handles and the handle support cuts 10, 11, respectively, as is also illustrated in FIG. 3. The same positioning of the cross and star configured punches is illustrated in FIGS. 7 and 8, respectively.

Figure 4:
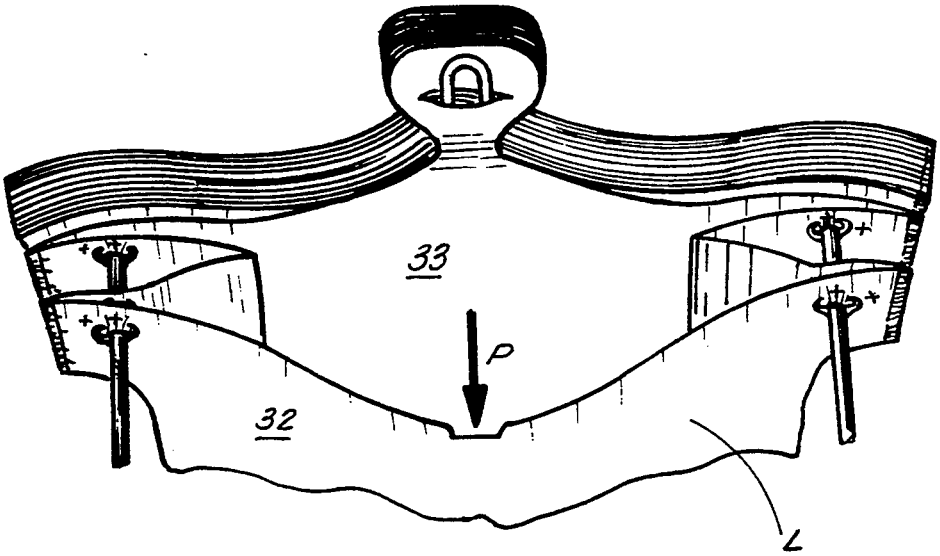
FIG. 4 is a upper, isometric, close up view of the opening of the lead bag, removing the front wall and handle portions from the pack and pulling same to open the handle in the supported, loading position.

As illustrated in FIG. 4, the present invention is utilized in much the same manner as conventional T-shirt bags, with the lead bag first placed in the loading position by grasping and directing the first wall of the bag forward by pulling same P, thereby separating the first 32 and second 33 walls of the bag, and opening said bag into a separated, supported (via the handle support racks), loading position.

Figure 5:
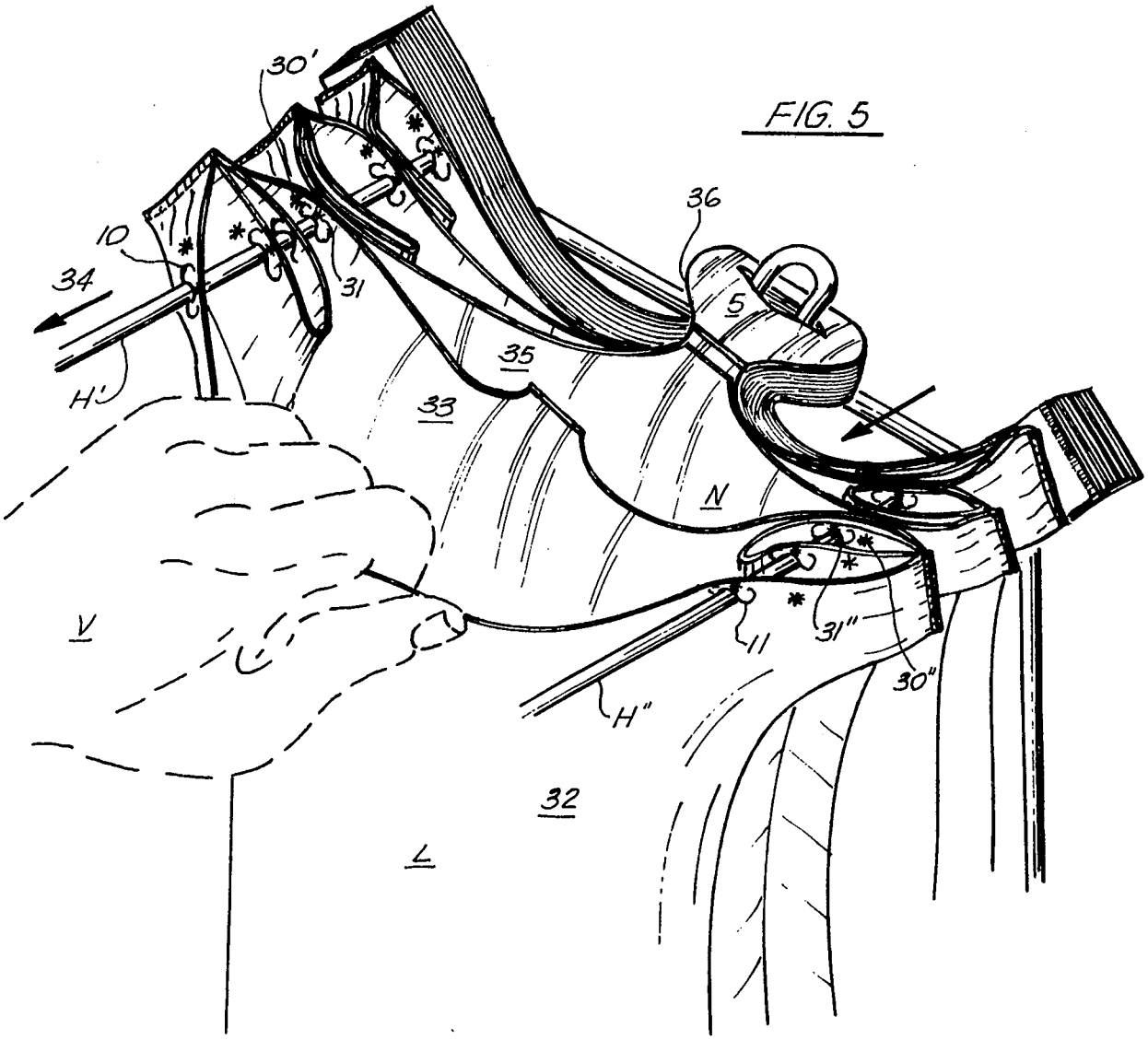
FIG. 5 is an isometric view of the invention of FIG. 4, illustrating the full installation of the bag pack upon a dispensing/supporting rack, and the relation of the exemplary self opening punches on the handles relative the installed pack upon the opening of the lead bag for loading.

FIG. 5 illustrates the operation of the bag, utilizing the star configured alternative punch design, which has been found to work as well as the cross or X punch configuration.

As shown, the user U pulls 34 the first wall 32 of the lead bag L loaded bag from the rack. In doing so, the bag handle support cuts 10, 11 ride along the handle support rods H, H'' away from the bag pack. However, the punches 30', 30'', 31', 31'' formed in the rear wall 33 of the lead bag cause the handle area of the rear wall of the lead bag to adhere to the front wall 35 of the next bag N sufficient to break 36 the bond between the upper bag wall and the tab 5, allowing said front wall 35 to be directed into an open position on the rack. The punches taught in the present invention permeate the walls of the bags such that the rear wall of the next bag N remains with the pack, and supported by tab 5, and hold the opened bag in place on the rack, as the lead bag is removed from the rack, the rear wall of the next bag holding said bag firm as the joined, punched area on the lead and next bag separates, as the lead bag is removed from the rack, before the rear wall 33 is removed from the support rods H', H'', but after the next bag is placed in an open, ready to be loaded position.

Figure 6:
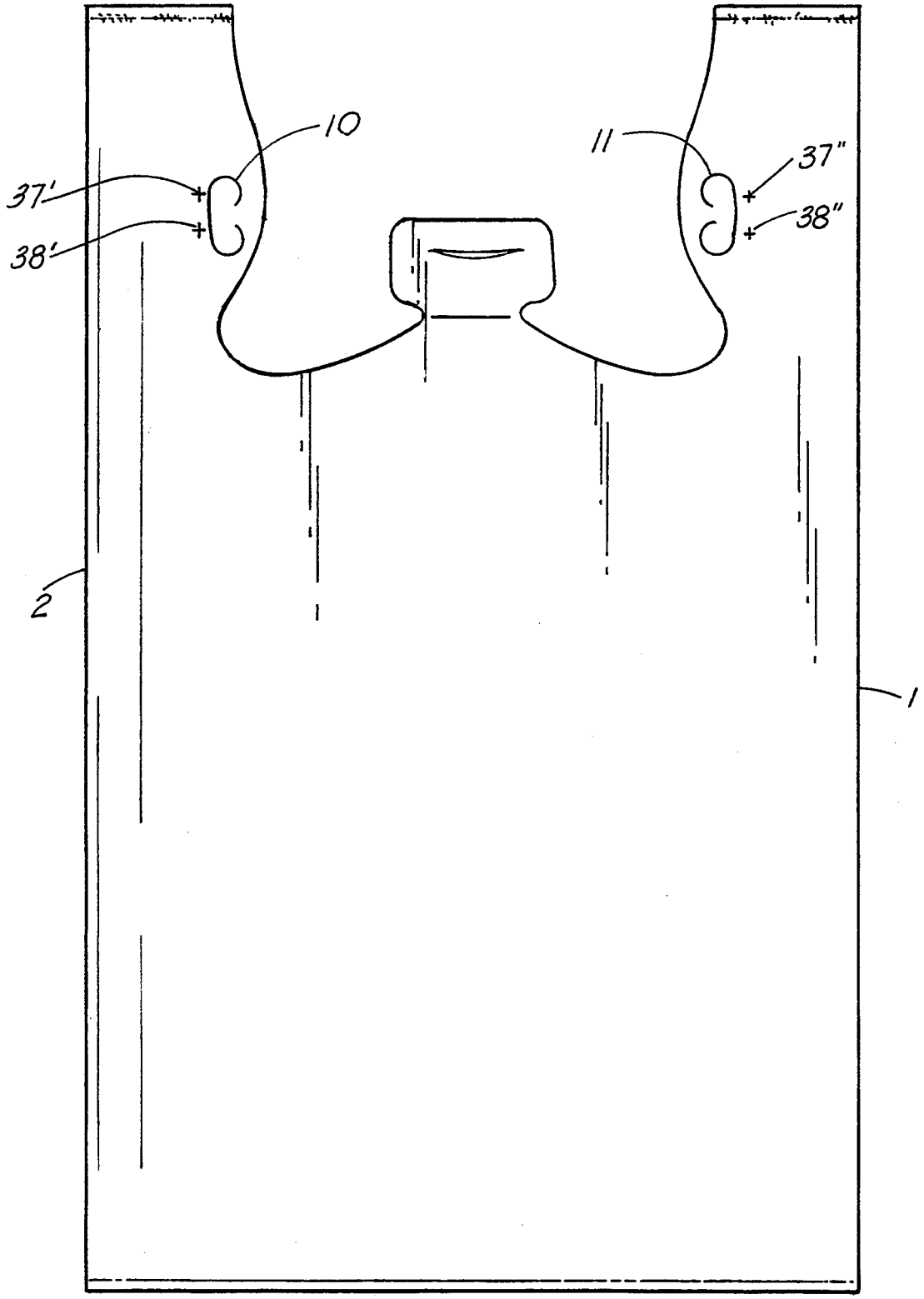
FIG. 6 is a frontal view of the bag of the invention of FIG. 1, illustrating an alternative placement of the punches outside the handle slits.

FIG. 6 illustrates an alternative placement of the punches, in this case, the alternative cross punches 37', 37'', 38', 38'' (but said placement can be utilized with all embodiments of stars taught in the present invention) whereby said punches 37', 38' and 37'', 38'' are situated in alignment with the longitudinal axis of their respective handles, between the handle support cuts 10, 11 and the outer edge of the bags 2, 1.

Figure 9A:
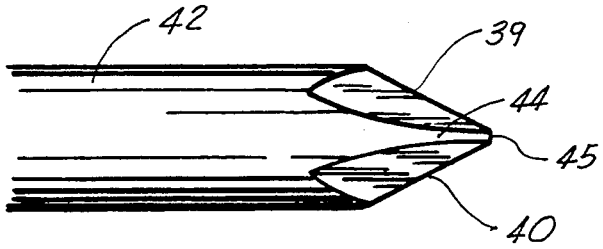
FIG. 9A illustrates a side, close up view of the tip of the cross punch of FIG. 7 of the alternative embodiment of the present invention.
Figure 9B:
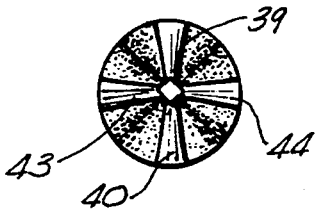
FIG. 9B illustrates an end, close up view of the tip of the cross punch of FIG. 7 of the alternative embodiment of the present invention.
Figure 10A:
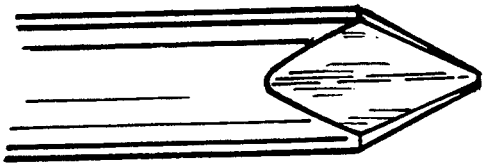
FIG. 10A illustrates a side, close up view of the tip of the punch of FIG. 1, illustrating an alternative, X-configured punch.
Figure 10B:
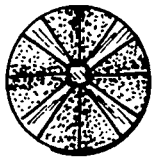
FIG. 10B illustrates an end, close up view of the tip of the punch of FIG. 1, illustrating an alternative, X-configured punch.
Figure 11A:
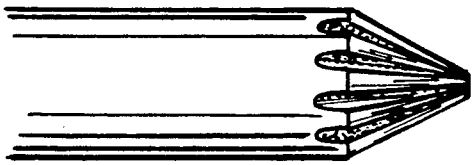
FIG. 11A illustrates a side, close up view of the tip of the punch of FIG. 1, illustrating an alternative, star configured punch.
Figure 11B:
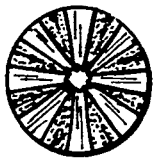
FIG. 11B illustrates a end, close up view of the tip of the punch of FIG. 1, illustrating an alternative, star configured punch.

FIGS. 9A and 9B illustrate the cross-configured punch 42 of the present invention, whereby there is provided a tip having upper 39 and lower 40 linear, longitudinal linear punch members perpendicularly intersecting with first 43 and second 44 linear, lateral punch members.

As further shown in FIG. 9A, each of the linear punch members are tapered to a generally linear end 45, forming the center of the punch. It has been found that the linear punch members provided at an angled taper, intersecting in a blunt end fashion is the key to the punch of the present invention. Accordingly, other punches having similar characteristics may also work in the fashion described in the present invention, as long as they comprise a plurality of linear punch members tapered to a generally linear, relatively blunt intersection formed at the general center of the punch. The punch, when applied, should partially meld the bag walls such that the rear wall of the lead bag in a bag pack is releasably melded with the front wall of the next bag in the pack.

Accordingly, the X configured punch and star or asterisk configured punch, shown in FIGS. 10A, 10B and 11A, 11B are provided with generally the same taper and intersection, the main difference being the placement and number of linear punch members.

For exemplary purposes, the hydraulic driver of the present invention is set at 80–90 barr for driving the punch into a bag pack of, for example, 50 high density thermoplastic bags.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A thermoplastic bag pack having first and second sides and bottom and top ends, said bag pack comprising a plurality of stacked, aligned bags, each of said bags comprising:

a bag mouth (5) having opposing ends and a medial area;

first (7) and second (6) handles emanating from said bag mouth, each of said handles having an upper end, a lower end, an inner side edge (8,9), and a medial area therebetween; each of said handles further having a handle support cut (10, 11) formed in the medial area of said handles;

said bag pack further comprising first and second punch stamps formed in each of said first and second handles, said first punch stamp formed between said upper end of said handle and said handle support cut, said second punch stamp formed in the medial area of said handle, generally adjacent to the handle support cut formed in said handles;

said first and second punch stamps formed by first and second punches, each having a tip including a plurality of linear punch members tapered to a generally linear, relatively blunt intersection formed at the general center of the punch.

2. The thermoplastic bag of claim 1, wherein said linear punch members of said tip of said first and second punches are configured to form a cross.

3. The thermoplastic bag of claim 1, wherein said linear punch members of said tip of said first and second punches are configured to form an X.

4. The thermoplastic bag of claim 1, wherein said linear punch members of said tip of said first and second punches are configured to form a star.

5. The method of dispensing individual bags from a bag pack on a rack by a user, the rack having first and second somewhat horizontally situated handle support members, and a tab support member, comprising the steps of:

a. providing a bag pack comprising a plurality of stacked bags, said bag pack further comprising binding means for releasably binding said bags to one another in stacked fashion, forming said pack, each of said bags having front and rear walls, first and second sides and bottom and top ends, each of said bags further comprising:

a bag mouth (5) having opposing ends and a medial area;

first (7) and second (6) handles emanating from said bag mouth, each of said handles having an upper end, a lower end, an inner side edge (8,9), and a medial area therebetween; each of said handles further having a handle support cut (10, 11) formed in the medial area of said handles;

a tab having a top edge, said tab emanating from said bag mouth, said tab comprising a bulbous section having formed therein a generally linear tab cut, forming a rupture zone;

said tab cut and said handle support members configured to cooperate in supporting said thermoplastic bag pack on said rack, said tab cut configured to accept the tab support member of the rack in such a fashion as to support the bag mouth, said handle support cut of each of said first and second handles configured to spread and accept the first and second handle support members of the rack, respectively;

said binding means further comprising first and second punch stamps formed in each of said first and second handles, in both the front and rear walls of each bag in said pack, said first punch stamp formed between said upper end of said handle and said handle support cut, said second punch stamp formed in the medial area of said handle, generally adjacent to the handle support cut formed in said handles;

said first and second punch stamps formed by first and second punches, respectively, each of said punches having tips comprising a plurality of linear punch members tapered to a generally linear, relatively blunt intersection formed at the general center of the punch;

said first and second punch stamps partially melding the rear wall of the lead bag on said bag pack with the front wall of a next bag on said stack;

b. spreading the handle support cut of each of said first and second handles or each of said bags in said bag pack to form a handle opening for each of said first and second handles;

c. directing the handle opening of the first handle of each of said bags in said bag pack about the first handle support member, supporting said first handle on the rack;

d. directing the handle opening of the second handle of each of said bags in said bag pack about the second handle support member, supporting said second handle on the rack;

e. directing the tab cut of said tab of each of said bags in said bag pack about the tab support member, supporting said tab on the rack;

f. dispensing a bag, comprising the steps of pulling the front wall of the lead bag away from the rack, spacing said front wall of said bag in a spaced, removed position relative the rear wall of said bag, opening said bag mouth;

g. loading said lead bag with goods;

h. grasping the handles of the lead bag, and directing same away from the rack;

i allowing the partially melded bag walls formed in the rear wall of said lead bag to pull the front wall of the next bag on the pack away from the pack, as the user pulls the front wall of the lead bag away from the rack, such that front wall of said next bag is separated from the rear wall, and said next bag is dispensed in an open position;

j. separating the partially melded rear wall of the lead bag on said bag pack from the front wall of a next bag on said stack as the lead bag is removed from said rack.

* * * * *